United States Patent [19]

Slade

[11] Patent Number: 4,640,107

[45] Date of Patent: Feb. 3, 1987

[54] SAFETY LOCK APPARATUS FOR AN ELECTRICAL PLUG

[76] Inventor: Luman C. Slade, 7717 Westwind La., Cincinnati, Ohio 45242

[21] Appl. No.: 807,967

[22] Filed: Dec. 12, 1985

[51] Int. Cl.[4] ..... E05B 65/00

[52] U.S. Cl. ..... 70/57; 70/39; 339/37

[58] Field of Search ..... 70/57, 39; 339/37, 39

[56] References Cited

U.S. PATENT DOCUMENTS

| | | | |
|---|---|---|---|
| 844,126 | 2/1907 | Hatfield | 339/37 |
| 2,541,638 | 2/1951 | Clevett | 70/39 |
| 2,654,073 | 9/1953 | Katz | 339/37 |
| 2,733,416 | 4/1955 | Evalt | 339/37 |
| 2,844,805 | 2/1956 | Darrell | 339/37 |
| 2,955,272 | 3/1959 | Gallardo | 339/37 |
| 2,983,133 | 5/1961 | Hruby | 70/39 |
| 3,067,402 | 12/1962 | Thaw | 339/39 |
| 3,345,600 | 8/1965 | Scherer | 339/37 |
| 3,539,968 | 9/1968 | Tunstall et al. | 339/37 |
| 3,662,320 | 5/1972 | Marx | 339/37 |
| 4,407,554 | 3/1981 | Drall | 339/37 |
| 4,413,488 | 10/1983 | Harminson, Jr. | 70/57 |
| 4,479,688 | 10/1984 | Tennings | 339/82 |

FOREIGN PATENT DOCUMENTS

| | | | |
|---|---|---|---|
| 509276 | 10/1930 | Fed. Rep. of Germany | 70/57 |
| 3304727 | 8/1984 | Fed. Rep. of Germany | 339/37 |

OTHER PUBLICATIONS

Page 54 of the Oct. 1985 issue of *Better Homes & Gardens.*

*Primary Examiner*—Henry E. Raduazo

*Attorney, Agent, or Firm*—Wood, Herron & Evans

[57] ABSTRACT

A safety lock apparatus for an electrical plug is provided which is preferably an integral one-piece plastic member having no moving parts. The apparatus cooperates with a padlock to render the prongs of the plug generally inaccessible within a block of plastic and the plug body is secured by the padlock to the block and/or to a shelf upon which the plug body is seated, a portion of the shelf being received between the padlock body and shackle of the padlock.

17 Claims, 2 Drawing Figures

SAFETY LOCK APPARATUS FOR AN ELECTRICAL PLUG

BACKGROUND OF THE INVENTION

This invention relates to a safety lock apparatus for an electrical plug and more particularly to such an apparatus which in conjunction with a standard padlock can be utilized to prevent insertion of the prongs of an electrical plug into an electrical outlet.

It has long been desirable to provide a simple mechanism to prevent the unauthorized use of an electrical appliance. For example, a child could possibly be injured if allowed to insert the prongs of a plug of an electrical appliance, such as an electric drill or the like, into an electrical outlet. Further, for example, there may be occasions where such electrical equipment such as televisions, video cassette recorders, home movie projectors, home and office computers, and the like, are not to be utilized by those without authorization or at inappropriate times. Finally, for example, it may be desirable to render the prongs of an electrical plug inaccessible so as to safeguard the easily bent prongs from damage thereby rendering the electrical appliance to which the electrical plug is coupled difficult to use.

Most prior art devices which have attempted to provide mechanisms to meet the above have generally operated by gripping or securing directly to the prongs of the electrical plug. For example, the devices disclosed in U.S. Pat. Nos. 4,413,488; 4,407,554; 3,662,320; 3,539,968; 3,345,600; 2,654,073; 2,844,805; and 2,733,416 all operate in this manner. These devices have several drawbacks, however. In some instances, the device disclosed is somewhat complex and difficult to use and requires manipulation of several parts. In other instances, the device will not operate to protect and/or prevent access to the prongs of the plug and thus can result in damage to the prongs and/or may encourage attempts to defeat the apparatus. Thus, in some instances, use of the device disclosed is unsatisfactory for the prongs are still generally accessible inviting attempts to defeat the apparatus. Such attempts may lead to injury if extreme caution is not taken. For example, some individuals may attempt to attach wires to the prongs for coupling to an electrical outlet. These efforts may lead to dangerous short-circuits and/or electrocution.

Other devices such as those disclosed in U.S. Pat. No. 2,955,272 and FIG. 5 of U.S. Pat. No. 2,654,073 have generally overcome some of the foregoing disadvantages in that the prongs of the plug are rendered inaccessible because the entire plug (plug body and prongs) is removably situated within a housing structure. However, each of these devices suffers drawbacks as well. In addition to the locking mechanism, these devices are comprised of a number of separate components which must be fastened together, and which are movable relative each other. Also, each of these devices generally presents an edge of a wall to the conductors of an electrical plug which exit from the housing and thus may introduce an additional source of danger to those attempting to defeat the apparatus. Additionally, the locking mechanism of these devices must be fastened securely to the device and is typically, therefore, not replaceable by the owner of the device should keys be lost and/or others obtain duplicate keys thus necessitating a change in the locking mechanism.

Accordingly, it has been one objective of the present invention to provide a safety lock apparatus for an electrical plug which is simple to use and does not, other than the locking mechanism, comprise component parts which must be put together.

A further objective of the present invention has been to provide such an apparatus which does not, other than the locking mechanism, comprise moving parts.

A yet further objective of the present invention has been to provide such an apparatus in which the prongs of the plug are rendered generally inaccessible thereby to prevent unauthorized access thereto and to minimize accidental electrical injury from attempts aimed at defeating the apparatus.

An even further objective of the present invention has been to provide such an apparatus which is easy to use to render the prongs of the plug generally inaccessible without securing the apparatus directly to the prongs.

A still further objective of the present invention has been to provide such an apparatus which is operable in conjunction with a standard easily replaceable padlock.

SUMMARY OF THE INVENTION

The apparatus provided by the present invention achieves the above objectives of the invention. Specifically, a safety lock apparatus for an electrical plug is provided which is a single, integral, plastic unit having a solid block portion apertured to receive the prongs of the plug and a shelf to which the plug body is securable, wherein a portion of the shelf is receivable between a padlock body and a shackle lockably receivable in the padlock body such that when the shackle is lockably received in the padlock body, the body portion of the plug is secured against the solid block portion and the prongs of the plug are rendered generally inaccessible in the solid block. Preferably, there is provided means associated with the shelf to prevent the shackle from moving away from the solid block portion so as to maintain the plug body secured to the solid block portion. Preferably, such means are apertures in the shelf through which the legs of the shackle are received. Further preferably, the shelf is provided with a pair of depending resilient gripper arms which are adapted to be situated around the padlock body to removably secure the padlock body thereto.

By virtue of the apparatus of the present invention, there is provided a one piece safety lock apparatus having no moving parts and which, in cooperation with a standard padlock, can easily render the prongs of an electrical plug generally inaccessible in such a fashion that attempts to defeat the apparatus will not likely result in accidental, dangerous electrical exposure to any person attempting to defeat the apparatus.

BRIEF DESCRIPTION OF THE DRAWINGS

These and other features and advantages of the invention will become more readily apparent from the following detailed description taken with the accompanying drawings in which.

DETAILED DESCRIPTION OF THE DRAWINGS

Figure 1:
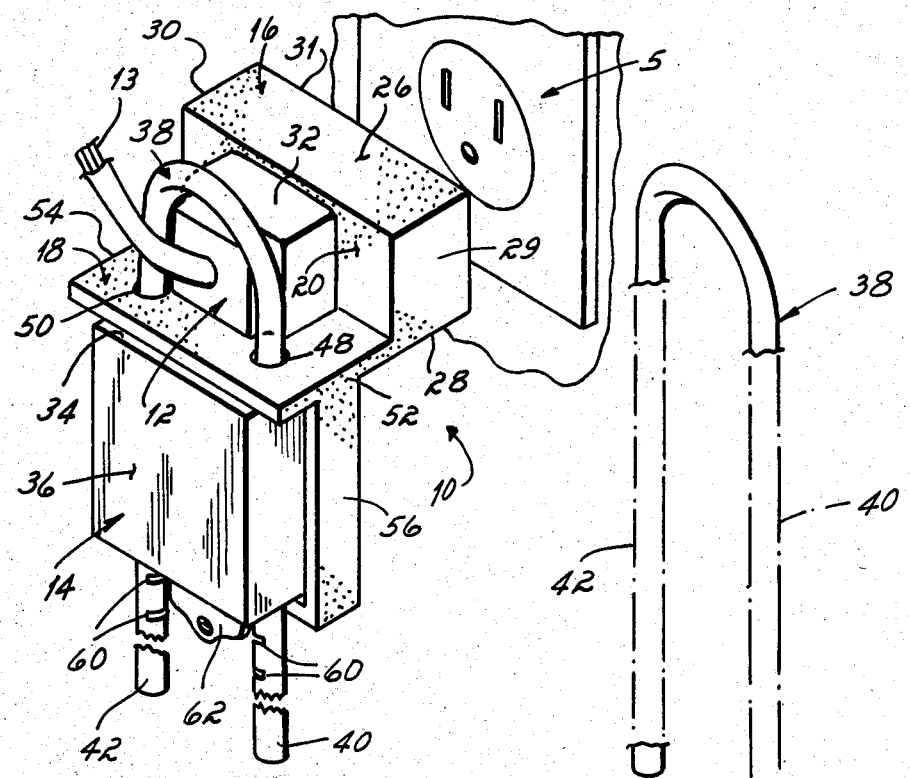
FIG. 1 is a perspective view of a safety lock apparatus according to the present invention, shown with a conventional padlock having its shackle lockably received in the padlock body to secure a plug body to the apparatus.

With reference to FIG. 1, there is shown a safety lock apparatus 10 according to the present invention with a plug 12 lockably held thereto by padlock 14. Plug 12 has a plurality of insulated conductors 13 extending therefrom and coupled to an electrical apparatus such as a television or other appliance or the like (not shown). As held to apparatus 10, prongs 22 (FIG. 2) of plug 12 are not accessible and, hence, cannot be inserted into an electrical outlet 5 which is adapted to be mechanically and electrically coupled to prongs 22.

Figure 2:
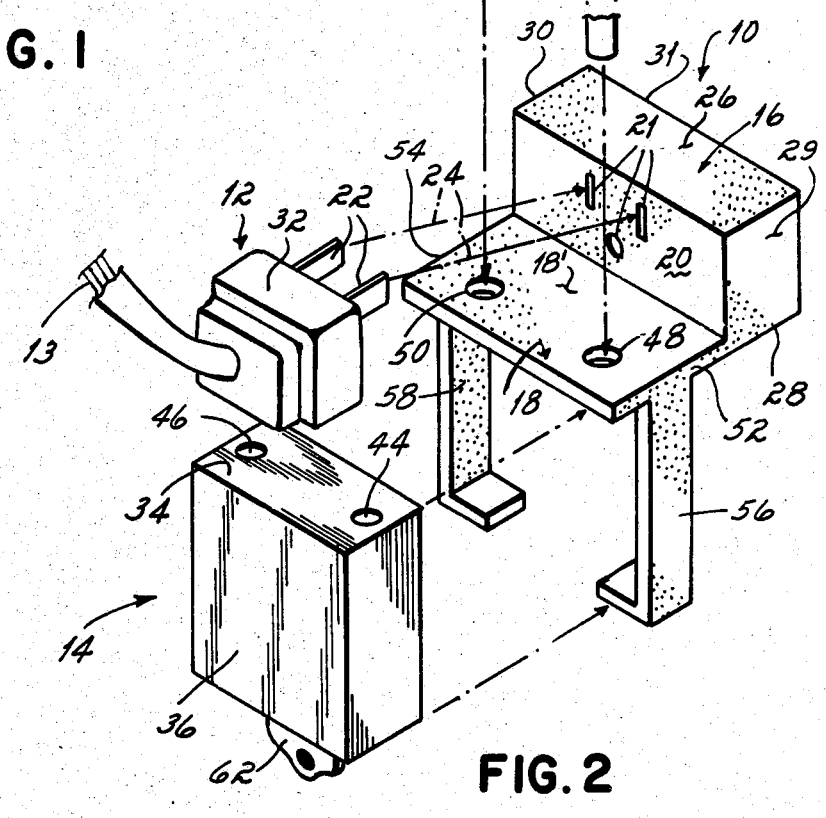
FIG. 2 is an exploded perspective view of the apparatus of FIG. 1 for purposes of explaining the present invention.

Apparatus 10 preferably comprises a one-piece integral plastic member as can be seen in FIG. 2, and has a forwardly block 16 and shelf 18 extending rearwardly therefrom. Block 16 comprises a front wall 20 apertured as at 21 to receive therethrough the prongs 22 (only two shown, however, front wall 20 is thrice-apertured to further receive a standard, round grounding prong (not shown) of plug 12) in a first direction as indicated by arrows 24. Block 16 further comprises at least a top wall 26 which spaces front wall 20 from any electrical outlet 5 against which apparatus 10 may be placed in an attempt to insert prongs 22 into such electrical outlet to thereby defeat apparatus 10. Block 16 also preferably includes solid bottom wall 28, side walls 29, 30 and rear wall 31 to prevent access to prongs 22 in block 16. Indeed, block 16 is preferably solid except for apertures 21. In any event, as can be readily understood from FIG. 1, when prongs 22 are received through aperture 21, they would also be spaced from such an electrical outlet by virture of at least one of walls 26, 28, 29 or 30.

Shelf 18 extends in a second direction from block 16 generally opposite first direction 24. Shelf 18 is preferably adapted to seat thereon plug body 32 of plug 12 as seen in FIG. 1. Further, a portion 18' of shelf 18 is situated between top wall 34 of padlock body 36 of padlock 14 and mating U-shaped shackle 38 thereof. Portion 18' of shelf 18 so received is positioned such that legs 40,42 of shackle 38 are lockably receivable into padlock body 36 through holes 44,46, respectively, thereof. To this end, shelf 18 is provided with right port 48 and left port 50 positioned near right and left sides 52, 54, respectively, of shelf 18 and through which are receivble legs 40,42, respectively, of U-shaped shackle 38. When legs 40,42 are received through ports 48,50, respectively, and locked into padlock body 36, shackle 38 cannot easily tilt in the aforesaid second direction, hence preventing removal of plug body 32 from securement against wall 20 as seen in FIG. 1.

Shelf 18 preferably further includes a pair of depending resilient gripper arms 56,58. Arms 56,58 depend from right side 52 and left side 54, respectively, of shelf 18 and in a direction generally perpendicular of shelf 18 (and the aforesaid second direction). Arms 56,58 are generally L-shaped to cooperate with shelf 18 such as to removably secure padlock body 36 against the underside of shelf 18 as seen in FIG. 1. Cooperation of arms 56,58 and ports 48,50 minimize or eliminate tilting of shackle 38 altogether.

In use, padlock body 36 is secured to shelf 18 by gripper arms 56,58 such that holes 44,46 are aligned with ports 48,50, respectively, of shelf 18. Thereafter, plug body 32 is seated on shelf 18 as prongs 22 are simultaneously received through apertures 21 in front wall 20 until plug body 32 abuts wall 20. Legs 40,42 of shackle 38 are passed through respective ports 48,50 and shackle 38 is further depressed to lockably engage with padlock body 36 until plug body 32 is secured against wall 20 and is further preferably sandwiched between U-shaped shackle 38 and shelf 18 as seen in FIG. 1. As is well understood, notches 60 on legs 40,42 are grippable by locking mechanism (not shown) within padlock body 36 until released by rotation of an appropriate key 62 in padlock body 36 as is well understood. Alternatively, padlock body 36 could be of the combination type and thus may not require a key but would require a combination and appropriate rotation of a tumbler dial (not shown) to release legs 40, 42 from padlock body 36 as is also well understood.

Padlock 14 is shown as having padlock body 36 and lockably receivable U-shaped shackle 38 which is completely removable from padlock body 36. Thus, when padlock body 32 is against shelf 18 by gripper arms 56,58, shackle 38 may be completely removed without padlock body 36 coming away from apparatus 10. Padlock 14 as described may be a Master Lock Company, Model Number MA-517 Multi Purpose Long Shackle Padlock, for example. Such a padlock is desired to permit apparatus 10 to accommodate plugs having variously sized plug bodies. However, padlock 14 need not have a completely removable shackle 38. Instead, one leg 42 of shackle 38 may be secured within padlock body 36 within hole 46 thereof. The other leg 40 is lockably receivable in padlock body 36 through hole 44 when shackle 38 is positioned such that leg 40 is aligned with hole 44 and shackle 38 is then depressed into locking engagement with padlock body 36 as is well understood. With the latter form of padlock 14, padlock body 36 cannot be held to shelf 18 until after leg 40 is inserted through port 50 and padlock body 36 is maneuvered such that leg 42 now extends through port 50 and padlock body 36 is aligned with grippr arms 56,58. Padlock body 36 would then be inserted between gripper arms 56,58 as before described. Thereafter, shackle 38 may be pivoted as desired. For example, to receive plug 12, shackle 38 would be pivoted such that leg 40 is not aligned with port 48 but is positioned away from front wall 20 thus providing unobstructed access to front wall 20. After prongs 22 are received through apertures 21 and plug body 32 abutted against wall 20 and preferably seated on shelf 18, shackle 38 may then be swung back into position such that leg 40 is aligned with port 48 and then depressed downwardly such that leg 40 is lockably received through hole 44 of padlock body 36 to secure plug body 32 to front wall 20.

When plug body 32 is secured to front wall 20, and preferably sandwiched between shelf portion 18' and shackle 38, as above described, prongs 22 are held securely within block 16 and are thus rendered generally inaccessible for all purposes. Moreover, because shackle 38 is of generally circular cross-section, insulated conductors 13 extending from plug body 32 will not typically encounter a sharp edge therefrom if someone should pull conductors 13 at an angle from apparatus 10.

Parents will find it useful to control or regulate the amount of time that their children watch television and video cassette recorders in deference to school homework or other constructive endeavors. This may be acomplished with the safety lock apparatus 10 of my present invention. Indeed, with the safety lock apparatus 10 of the present invention, it is thus possible to lock out use of televisions, video cassette recorders, home movie projectors, home and office computers and home appliances and power tools and the like.

Another important use of safety lock apparatus 10 of the present invention is for parents to control, from a suitability standpoint, what their children watch or listen to. Use of the safety lock apparatus 10 of my present invention can be used to prevent use of televisions or the like when parents or other custodians are not at home or not available to supervise the "content" of the programs available. Parents and others can exclude programs of violence, explicit sex, or of no redeeming value if they choose.

Additionally, use of the safety lock apparatus 10 of my present invention can help assure the privacy of material stored on home or office computers. Unauthorized persons can be prevented from unauthorized or undesired use of such equipment. The ability to restrict use of such devices with my apparatus 10 can aid in preventing possible destruction of valuable data or viewing and/or hearing private material.

In addition to being of great practical value, safety lock apparatus 10 of my invention is a very simple design, is easily constructed and manufactured, and is desirably easy to use and yet not easily defeated as are many of the devices disclosed in the prior art. Indeed, safety lock apparatus 10 of the present invention is believed to be very safe in that no part of the prongs 22 are exposed when plug 12 is secured to apparatus 10. This will discourage the desire on the part of the curious and clever from seeking an opportunity to insert prongs 22 into an electrical outlet or to attach wires (not shown) to the no longer exposed prongs. The latter is very important in that without rendering access to the prongs 22 generally inacessible for all purposes, children or others trying to defeat the device might incur serious injury and may even accidentally electrocute themselves.

All of the foregoing are achieved with apparatus 10 of my invention which is preferably a one-piece unit having no movable parts other than the padlock. Hence, my invention may be easily and conveniently used without special skills or adept maneuvering. Also, should it become necessary, the locking mechanism may be easily changed without special tools or know-how merely by replacing the existing padlock with another padlock readily available in the marketplace.

While the invention has been described as a one-piece plastic member, alternative constructions may be employed. For example, apparatus 10 could be constructed of sheet metal formed to a general Z-shape and having shelf 18, wall 20 and wall 26, for example, with depending arms 56,58. Other variations may also present themselves within the scope of my invention.

Having described the invention, what I claim is:

1. A safety lock apparatus for an electrical plug having a plug body from which extends a plurality of prongs adapted to be inserted into an electrical outlet, the safety lock apparatus comprising:

receiver means for receiving therethrough, in a first direction, prongs of a plug;

spacer means extending generally in said first direction from said receiver means for spacing said receiver means from an electrical outlet so that prongs received through said receiver means are prevented from being inserted into the electrical outlet;

shelf means extending from said receiver means in a second direction generally opposite said first direction and cooperable with a padlock for securing a plug body of a plug to said receiver means when its prongs are received through said receiver means, a portion of said shelf means adapted to be placed between a padlock body of the padlock and a U-shaped shackle of the padlock so that (i) the shackle is lockably receivable in the padlock body and (ii) the plug body is secured to said receiver means, whereby to prevent removal from said receiver means prongs extending from a plug body so secured; and securement means operably associated with said shelf means for securing a portion of the padlock to said shelf means, said securement means comprising a pair of spaced apart resilient gripper arms depending from said seat means in a direction generally perpendicular said second direction and between which a padlock is removably grippable.

2. The safety lock apparatus of claim 1, said securing means including port means in said shelf means through which a U-shaped shackle is receivable.

3. The safety lock apparatus of claim 1, said shelf means adapted to seat thereon a plug body so that a plug body seated thereon is sandwiched between said shelf means and the shackle.

4. A safety lock apparatus for an electrical plug having a plug body from which extends a plurality of prongs adapted to be inserted into an electrical outlet, the safety lock apparatus comprising:

receiver means for receiving therethrough, in a first direction, prongs of a plug;

spacer means extending generally in said first direction from said receiver means for spacing said receiver means from an electrical outlet so that prongs received through said receiver means are prevented from being inserted into the electrical outlet;

shelf means extending from said receiver means in a second direction generally opposite said first direction for seating thereon a plug body of a plug when its prongs are received through said receiver means, a portion of said shelf means adapted to be placed between a padlock body of a padlock and a U-shaped shackle of the padlock so that (i) the shackle is lockably receivable in the padlock body and (ii) a plug body seated thereon is securably sandwichable thereagainst, whereby to prevent removal from said receiver means prongs extending from a plug body so sandwiched; and securement means operably associated with said shelf means for securing a portion of the padlock to said shelf means, said securement means comprising a pair of spaced apart resilient gripper arms depending from said shelf means in a direction generally perpendicular said second direction and between which a padlock body is removably grippable.

5. The safety lock apparatus of claim 4, said receiver means and said spacer means cooperating to define a substantially solid block being apertured to receive plug prongs.

6. The safety lock apparatus of claim 4, said receiver means and said spacer means each including a wall, said receiver means wall having apertures through which plug prongs are receivable.

7. The safety lock apparatus of claim 4, said shelf means having a forward end adjacent said receiver means, and left and right sides, said gripper arms depending from said left and right sides, respectively.

8. The safety lock apparatus of claim 7, said securement means including left and right port means in said shelf means and adjacent said left and right sides, respectively, each said port means for receiving therethrough a respective leg of a U-shaped shackle.

9. The safety lock apparatus of claim 4, said securement means including port means in said shelf means through which a U-shaped shackle is receivable.

10. In combination:

a padlock comprising a padlock body and a U-shaped shackle having at least one leg lockably receivable in the padlock body; and a safety lock apparatus for an electrical plug having a plug body from which extends a plurality of prongs adapted to be inserted into an electrical outlet, the safety lock apparatus comprising:

receiver means for receiving there-through, in a first direction, prongs of a plug;

spacer means extending generally in said first direction from said receiver means for spacing said receiver means from an electrical outlet so that prongs received through said receiver means are prevented from being inserted into the electrical outlet;

shelf means extending from said receiver means in a second direction generally opposite said first direction and cooperating with said padlock for securing a plug body of a plug to said receiver means when its prongs are received through said receiver means, a portion of said shelf means adapted to be placed between the padlock body and the U-shaped shackle so that (i) the shackle is lockably receivable in the padlock body and (ii) the plug body is secured to said receiver means whereby to prevent removal from said receiver means prongs extending from a plug body so secured; and securement means operably associated with said shelf means for securing a portion of said padlock to said shelf means, said securement means comprising a pair of spaced apart resilient gripper arms depending from said shelf means in a direction generally perpendicular said second direction and between which said padlock body is removably gripped.

11. The safety lock apparatus of claim 10, said securement means including port means in said shelf means through which said U-shaped shackle is received.

12. In combination:

a padlock comprising a padlock body and a U-shaped shackle having at least one leg lockably receivable in the padlock body; and a safety lock apparatus for an electrical plug having a plug body from which extends a plurality of prongs adapted to be inserted into an electrical outlet, the safety lock apparatus comprising:

receiver means for receiving therethrough, in a first direction, prongs of a plug;

spacer means extending generally in said first direction from said receiver means for spacing said receiver means from an electrical outlet so that prongs received through said receiver means are prevented from being inserted into the electrical outlet;

shelf means extending from said receiver means in a second direction generally opposite said first direction and cooperating with said padlock for securing a plug body of a plug to said receiver means when its prongs are received through said receiver means, a portion of said shelf means adapted to be placed between the padlock body and the U-shaped shackle so that (i) the shackle is lockably receivable in the padlock body and (ii) the plug body is secured to said receiver means whereby to prevent removal from said receiver means prongs extending from a plug body so secured; and securement means operably associated with said shelf means for securing a portion of said padlock to said shelf means, said securement means comprising a pair of spaced apart resilient gripper arms depending from said shelf means in a direction generally perpendicular said second direction and between which said padlock body is removably gripped.

13. The safety lock apparatus of claim 12, said receiver means and said spacer means cooperating to define a substantially solid block being apertured to receive plug prongs.

14. The safety lock apparatus of claim 12, said receiver means and said spacer means each including a wall, said receiver means wall having apertures through which plug prongs are receivable.

15. The safety lock apparatus of claim 12, said shelf means having a forward end adjacent said receiver means, and left and right sides, said gripper arms depending from said left and right sides, respectively.

16. The safety lock apparatus of claim 15, said securement means including left and right port means in said shelf means and adjacent said left and right sides, respectively, each said port means for receiving therethrough a respective leg of said U-shaped shackle.

17. The safety lock apparatus of claim 12, said securement means including port means in said shelf means through which said U-shaped shackle is received.

* * * * *